US011134716B2

(12) United States Patent
Dick et al.

(10) Patent No.: US 11,134,716 B2
(45) Date of Patent: Oct. 5, 2021

(54) ELECTRONIC CIGARETTE PRODUCT AND CARTRIDGE HAVING A MICROSYSTEM UNIT ADDING DEVICE

(71) Applicant: HAUNI MASCHINENBAU GMBH, Hamburg (DE)

(72) Inventors: Jürgen Dick, Hohenhorn (DE); Marc Kessler, Hamburg (DE); Rene Schmidt, Buchholz i.d.N. (DE)

(73) Assignee: HAUNI MASCHINENBAU GMBH, Hamburg (DE)

( * ) Notice: Subject to any disclaimer, the term of this patent is extended or adjusted under 35 U.S.C. 154(b) by 105 days.

(21) Appl. No.: 16/083,527

(22) PCT Filed: Mar. 3, 2017

(86) PCT No.: PCT/EP2017/055009
§ 371 (c)(1),
(2) Date: Sep. 10, 2018

(87) PCT Pub. No.: WO2017/153270
PCT Pub. Date: Sep. 14, 2017

(65) Prior Publication Data

US 2020/0205478 A1 Jul. 2, 2020

(30) Foreign Application Priority Data

Mar. 8, 2016 (DE) ..... 10 2016 002 665.0

(51) Int. Cl.
*A24F 13/00* (2006.01)
*A24F 17/00* (2006.01)
(Continued)

(52) U.S. Cl.
CPC ..... *A24F 40/30* (2020.01); *A24F 40/42* (2020.01); *A24F 40/46* (2020.01); *A24F 40/57* (2020.01);
(Continued)

(58) Field of Classification Search
CPC ..... A24F 47/008; A24F 47/002; A24F 40/00; A24F 40/42; A24F 40/48; A24F 40/485; A24F 40/40; A24F 40/46
(Continued)

(56) References Cited

U.S. PATENT DOCUMENTS 5,894,841 A 4/1999 Voges
8,881,737 B2 11/2014 Collett et al.
(Continued)

FOREIGN PATENT DOCUMENTS

CN 101228969 A 7/2008
CN 101455447 A 6/2009
(Continued)

OTHER PUBLICATIONS

National Intellectual Property Administration, P.R. China, Search and Examination Report, Application No. 201780016130.6, dated Jul. 19, 2021, 12 pages.

*Primary Examiner* — Zhae Moon Hyeon
(74) *Attorney, Agent, or Firm* — Saliwanchik, Lloyd & Eisenschenk

(57) ABSTRACT

The invention relates to an electronic cigarette product, comprising a housing having a mouth end, at least one air inlet opening, and an air channel extending in the housing between the at least one air inlet opening and the mouth end, a liquid reservoir, an electrical energy store, and an adding device connected to the liquid reservoir for generating vapor and/or aerosol from liquid extracted from the liquid reservoir, and adding the vapor and/or aerosol to an air flow flowing in the air channel. The adding device is at least partly a micro-system unit.

21 Claims, 6 Drawing Sheets

(51) Int. Cl.

| | |
|---|---|
| ***A24F 25/00*** | (2006.01) |
| ***A24F 40/30*** | (2020.01) |
| ***A24F 40/65*** | (2020.01) |
| ***A24F 40/46*** | (2020.01) |
| ***A24F 40/57*** | (2020.01) |
| ***A24F 40/42*** | (2020.01) |
| ***A24F 40/60*** | (2020.01) |
| *A24F 40/10* | (2020.01) |

(52) U.S. Cl.
CPC ..... *A24F 40/60* (2020.01); *A24F 40/65* (2020.01); *A24F 40/10* (2020.01)

(58) Field of Classification Search
USPC ..... 131/329, 328
See application file for complete search history.

(56) References Cited

U.S. PATENT DOCUMENTS

2005/0016550 A1* 1/2005 Katase ..... A24F 47/008 131/194
2005/0067503 A1* 3/2005 Katase ..... A61M 15/025 239/373
2006/0196518 A1 9/2006 Hon
2011/0265806 A1* 11/2011 Alarcon ..... A24F 40/90 131/273
2012/0048266 A1 3/2012 Alelov
2013/0340775 A1 12/2013 Juster
2014/0060554 A1* 3/2014 Collett ..... A24F 40/51 131/328
2014/0096781 A1* 4/2014 Sears ..... A24F 47/008 131/328
2014/0261488 A1 9/2014 Tucker
2014/0283855 A1* 9/2014 Hawes ..... A24F 40/485 131/328
2014/0338685 A1* 11/2014 Amir ..... A24F 40/50 131/329
2015/0114409 A1* 4/2015 Brammer ..... A24F 40/42 131/329
2015/0181943 A1 7/2015 Li et al.
2015/0230521 A1 8/2015 Talon
2015/0245658 A1* 9/2015 Worm ..... A24F 40/50 131/328
2015/0342257 A1 12/2015 Chen
2016/0007653 A1* 1/2016 Tu ..... F22B 1/284 392/403
2016/0021930 A1 1/2016 Minskoff et al.
2016/0050974 A1 2/2016 Galloway et al.
2016/0295913 A1* 10/2016 Guo ..... A24F 40/42
2017/0172207 A1 6/2017 Liu
2017/0280775 A1* 10/2017 Manga ..... B05B 7/0012

FOREIGN PATENT DOCUMENTS

| | | |
|---|---|---|
| CN | 203762290 U | 8/2014 |
| CN | 105286088 | 2/2016 |
| CN | 205040652 U | 2/2016 |
| CN | 106132220 | 11/2016 |
| EP | 0 845 220 A1 | 6/1998 |
| EP | 2388040 | 11/2011 |
| JP | 8-511966 | 12/1996 |
| JP | 2001-161819 | 6/2001 |
| JP | 2006-524494 | 11/2006 |
| JP | 2015-503916 | 2/2015 |
| WO | 20100082543 | 7/2012 |
| WO | 2014101734 | 7/2014 |
| WO | WO 2015/077645 A1 | 5/2015 |
| WO | 2015180370 | 12/2015 |
| WO | 2015196463 | 12/2015 |
| WO | 2016008217 | 1/2016 |

* cited by examiner

ELECTRONIC CIGARETTE PRODUCT AND CARTRIDGE HAVING A MICROSYSTEM UNIT ADDING DEVICE

CROSS REFERENCE TO RELATED APPLICATIONS

This application is a National Stage Application of International Application Number PCT/EP2017/055009, filed Mar. 3, 2017; which claims priority to German Patent Application No. 10 2016 002 665.0, filed Mar. 8, 2016.

FIELD OF THE INVENTION

The present invention relates to an electronic cigarette product, comprising a housing having a mouth end, at least one air inlet opening and an air channel that extends in the housing between the at least one air inlet opening and the mouth end, a liquid tank, an electrical energy store and an adding device, connected to the liquid tank, for producing vapour and/or aerosol from liquid taken from the liquid tank and for adding the vapour and/or aerosol to an air flow flowing in the air channel.

BACKGROUND

The majority of electronic cigarette products currently on the market are based on the wick-coil principle. A wick, for example made of glass fibres, is partially wrapped in a heating coil and is in contact with a liquid store. When the heating coil is heated, the liquid in the wick evaporates in the region of the heating coil. Due to the capillary action, the evaporated liquid is conveyed out of the liquid reservoir. An electronic cigarette of this kind is disclosed in US 2016/0021930 A1 by way of example.

The conveyance of the liquid and the amount of vapour are inseparably interlinked via the wick in this case. The evaporative capacity determines the amount of vapour; however, smokers typically desire a large amount of vapour in order to achieve a lasting smoking experience. Due to the high, substantially system-related inhomogeneous temperature-liquid distribution that is required for this, there is a possible partial risk of overheating, which leads to undesired pollutant emissions. A further disadvantage of electronic cigarettes is susceptibility to leakage if there are fluctuations in air pressure.

BRIEF SUMMARY

The object of the invention is to provide a safe, high-quality and certifiable electronic cigarette product and a cartridge, in the case of which the above-mentioned disadvantages of the potential risk of overheating and pollutant emissions associated therewith can be prevented.

The invention achieves this object by means of the features of the independent claims. Designing at least substantial parts of the adding device as a microsystem unit makes it possible, according to the invention, to completely separate conveying or dosing the liquid from heating said liquid for the purpose of evaporation. Liquid is conveyed or injected into the chamber inside the adding device by micro-dosing, advantageously by means of an open-jet atomiser according to the inkjet or bubblejet principle. A precisely temperature-controlled heating element may be provided as part of an evaporator at a distance from and functionally separated from said atomiser. In this case, the temperature of the heating element can be adjusted or controlled completely independently of the volumetric flow rate of the liquid. At a fixed temperature, the amount of liquid conveyed, and therefore the amount of vapour/aerosol, can be adjusted as desired. By precisely controlling/regulating the temperature of the evaporator heating element, overheating, and pollutants that are produced as a result, for example acryl compounds, can be fully prevented.

The microsystem technology used according to the invention allows micrometre-precise and exactly reproducible production of different electromechanical functional groups including sensor systems and actuators on a substrate, for example made of polymer, glass, ceramic, metal, metalloid, e.g. silicon, silicon compounds or metal oxide compounds, in a single manufacturing process. In this way, the product quality required for mass production and certifiability can be ensured according to the invention. Advantageously, at least the atomiser, and, more advantageously, also the evaporator of the adding device, is designed as a microsystem unit. The evaporator, in particular, may alternatively be made of more cost-effective materials, however.

Preferably, the liquid tank and the adding device are arranged in a replaceable cartridge. Therefore, when the liquid tank is emptied, it is not necessary to dispose of the entire cigarette product, but only to replace the empty cartridge with a filled cartridge. A significant part of the cigarette product, including the energy store, can therefore be reused. The adding device as part of the cartridge has the significant advantage that, as a result, a defined interface is produced which makes it possible to replace the cartridge without leaks and without complex sealing measures, as the microstructure of the microsystem unit can be more easily sealed or is even self-sealing due to surface tension.

The cartridge may advantageously comprise a data or information store for storing information and/or parameters that are relevant to the cartridge.

Preferably, the ratio of the greatest extension of the microsystem unit to the average diameter of the substantially rod-shaped housing in the region of the adding device is less than 0.5 and more preferably less than 0.4 and even more preferably less than 0.3 and particularly advantageously less than 0.2. A compact design of the microsystem unit increases the flexibility with regard to possible arrangements of the microsystem unit in the cigarette product or in the cartridge.

The atomiser is preferably an open-jet atomiser comprising a thermoactuator or piezo actuator and a nozzle arranged downstream thereof. In advantageous embodiments of the invention, the atomiser may comprise an electric preheating element and a preheating chamber for preheating the liquid entering the adding device from the liquid tank. It may be advantageous if an electric direct current (DC) voltage is applied to a metal part of the atomiser in contact with the liquid, in order to ionise the atomised liquid.

Preferably, the heat output of the evaporator heating element can be controlled and/or regulated to a defined desired temperature. In advantageous embodiments, the evaporator may comprise a piezo element that is coupled to the electric heating element. The heating element that vibrates due to piezo excitation may lead to more effective evaporation and/or the achievement of self-cleaning effects, i.e. the prevention of scorching or adhesions.

In advantageous embodiments of the invention, different liquids from a plurality of liquid tanks may be atomised using a plurality of atomisers, a corresponding plurality of evaporators and heating elements preferably being assigned to the atomisers. In this way, an active ingredient, for example, can be specifically added to a main liquid. In this case, it is particularly advantageous if the heat output of the heating elements can be individually controlled and/or regulated to defined desired temperatures, as this makes it possible to adapt and optimally select the relevant heating temperature for each liquid.

Particularly advantageously, the liquid tank is a flexible pouch. As a result, it is possible to completely empty the liquid tank irrespective of location and without leakage.

In an advantageous development of the invention, at least one liquid store is provided in the form of a liquid-on-chip device. In the case of this similarly microsystem-based technology, it is possible to store small amounts of liquid directly on a chip, comparable with a droplet that is sealed in a type of blister and can be released by deliberate activation. For example, an open-jet atomiser could be provided for atomising a main liquid and the actual process of adding flavours and/or active ingredients could take place by means of a liquid-on-chip device.

In practical embodiments of the invention, a plurality of atomisers may be arranged in the adding device, in particular in the form of a matrix or an array. A corresponding plurality of evaporators may be assigned to the plurality of atomisers, for example also in the form of a matrix. In order to produce greater amounts of vapour, a plurality of adding devices or microsystem units may be arranged in the cigarette product.

BRIEF DESCRIPTION OF DRAWINGS

The invention is explained in greater detail in the following on the basis of preferred embodiments with reference to the accompanying drawings, in which.

DETAILED DESCRIPTION

Figure 1:
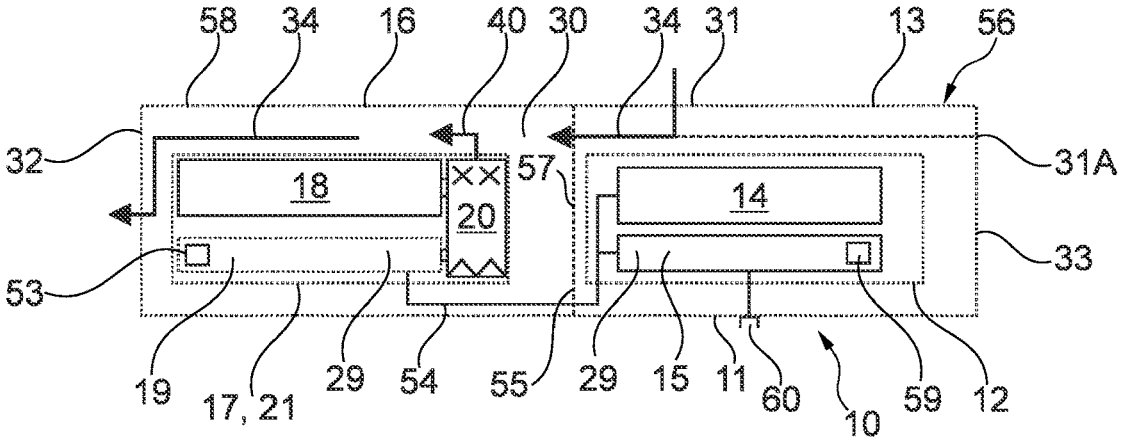
FIG. 1 is a cross-sectional view of an electronic cigarette product in an embodiment of the invention.

The electronic cigarette product 10 comprises a substantially rod-shaped or cylindrical housing 11, which may be round, oval, elliptical, square, rectangular, polygonal or otherwise shaped in cross section. In the housing 11, an air channel 30 is provided between at least one air inlet opening 31 and the mouth end 32 of the cigarette product 10. In this case, the mouth end 32 of the cigarette product 10 refers to the end at which the user draws for inhalation and thereby applies a vacuum to the cigarette product 10 and produces an air flow 34 in the air channel 30. At least one air inlet opening 31 can be arranged in the outer side of the housing 11. Additionally or alternatively, at least one air inlet opening 31A can be arranged at the remote end 33 of the cigarette product 10. The remote end 33 of the cigarette product 10 refers to the end of the cigarette product 10 that is opposite to the mouth end 32.

The air supply through the air inlet opening(s) 31, 31A may be adjustable, in particular by means of variable flow resistance, for example by means of adjustable air slots or a rotatable ring having a regulating opening. Furthermore, a (fine) filter may be provided on the air inlet opening(s) 31, 31A for cleaning the aspirated air. An ionising apparatus for ionising the aspirated air is also possible, which can lead to better droplet absorption and better biological compatibility. Finally, an apparatus for preheating or controlling the temperature of the aspirated air in advance is conceivable.

The cigarette product 10 is preferably designed such that the drag resistance at the mouth end 32 is preferably in the range between 50 and 130 mm of water column, more preferably between 80 and 120 mm of water column, even more preferably between 90 and 110 mm of water column, and optimally between 95 and 105 mm of water column. In this case, the drag resistance relates to the pressure which is needed in order to draw air along the entire length of the cigarette product 10 at a rate of 17.5 ml/s at 22° C. and 101 kPa (760 Torr) and which is measured in compliance with ISO 6565:2011.

The cigarette product 10 comprises a first (axial) portion 13, advantageously at the remote end 33 of the cigarette product 10, in which portion an electronic energy supply unit 12 having an electrical energy store 14 and an electrical/electronic unit 15 is arranged. The energy store 14 extends advantageously in the axial direction of the cigarette product 10. The electrical/electronic unit 15 is advantageously arranged laterally adjacent to the energy store 14. The energy store 14 may be an electrochemical disposable battery, a rechargeable electrochemical battery, e.g. a lithium-ion battery, or another fuel cell.

The cigarette product 10 further comprises a second (axial) portion 16, advantageously at the mouth end 32 of the cigarette product 10, in which portion a consumption unit 17 having a liquid tank 18, an electrical unit 19 and an adding device 20 is arranged. The liquid tank 18 extends advantageously in the axial direction of the cigarette product 10.

Instead of the separated electrical/electronic units 15, 19, a single electrical/electronic unit may be provided, which may be arranged either in the energy supply unit 12 or in the consumption unit 17. All the electrical/electronic units of the cigarette product 10 are collectively referred to as a control assembly 29 in the following.

Advantageously, a sensor, for example a pressure sensor or a pressure switch, is arranged in the housing 11, it being possible for the control assembly to determine an operating state of the cigarette product 10 on the basis of a sensor signal output by the sensor, in that a user draws on the mouth end 32 of the cigarette product 10 in order to inhale. In this operating state, the control assembly 29 actuates the adding device 20 in order to add liquid 50 from the liquid tank 18 into the air flow 34 as an addition 40 in the form of small liquid droplets as mist/aerosol and/or in a gaseous form as vapour. The liquid that is stored in the liquid tank 18 and is to be dosed is, for example, a mixture of 1,2-propylene glycol, glycerol and water, into which one or more flavours and/or active ingredients, such as nicotine, can be mixed.

The second portion 16 containing the liquid tank 18 or the consumption unit 17 is advantageously designed as a cartridge 21 that can be replaced by the user, i.e. as a disposable part. The rest of the cigarette product 10, in particular the first portion 13 containing the energy store 14, is advantageously designed as a main part 56 that can be reused by the user, i.e. as a reusable part. The cartridge 21 is designed such that the user can connect it to the main part 56 and detach it from the main part 56. A partition surface or interface 57 is therefore formed between the cartridge 21 and the main part 56. A cartridge housing 58 may form part of the housing 11 of the cigarette product 10.

In other embodiments (see FIG. 2), the consumption unit 17 is designed as the cartridge 21 that can be inserted into the reusable main part 56 of the cigarette product 10 and removed therefrom by the user. In this case, the cartridge housing 58 is a housing that is separate from the housing 11 of the cigarette product 10.

Figure 2:
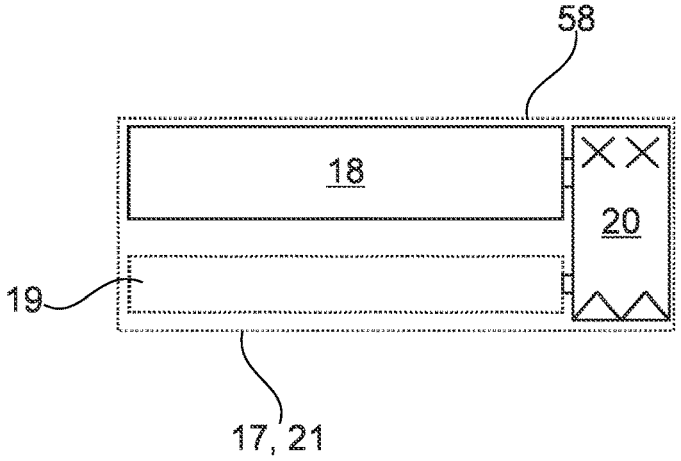
FIG. 2 is a cross-sectional view of a cartridge for an electronic cigarette product.

The cartridge 21 comprises at least the liquid tank 18 and the adding device 20. The cartridge 21 may, as shown in FIG. 2, comprise the electrical/electronic unit 19. In other embodiments, the electrical/electronic unit 19 is in whole or in part a fixed component of the main part 56. As well as being used in rod-shaped cigarette products 10, the cartridge 21 may be inserted into other products, for example into an electronic pipe. The energy store 14 is usually not part of the cartridge 21, but rather part of the reusable main part 56.

In order to prevent leakage, the liquid tank 18 is preferably sealed so as to be liquid-tight and retains this property under all occurring ambient conditions, i.e. over a wide temperature and ambient pressure range. Advantageously, ambient air is therefore prevented from entering the liquid tank 18, and therefore only liquid is taken from the liquid tank 18. Furthermore, it should be possible to empty the liquid tank 18 as completely as possible irrespective of location. Preferably, the liquid tank 18 is filled in a certified manner and is not refillable, in order to reliably prevent misuse and manipulation.

In order to implement the above-mentioned requirements, the liquid tank 18 may have an advantageously viscosity-dependent capillary structure and/or be designed to produce a microfluidic system. Emptying by means of, for example, a displacement device that is electrically driven, e.g. by means of a spindle drive, preferably by using a piston in a cylindrical tank, is possible.

In an advantageous embodiment, the liquid tank 18 is a flexible pouch. As a result, it is possible to completely empty the liquid tank 18 irrespective of location and without leakage.

The liquid tank 18 may comprise a container, a fixture or a structural component, into which the above-mentioned capillary structure and/or the pouch is inserted. A typical tank volume of the liquid tank 18 is in the range between 0.5 ml and 2 ml. The cigarette product 10 may advantageously comprise a fill level control means for the liquid tank 18 that can be linked with the number of drags, for example. The liquid tank 18 is preferably made of an inert and/or food-grade or pharmaceutically suitable material, in particular a plastics material, it being possible for the material to be optically transparent or opaque.

The liquid tank 18 can be mechanically coupled to or uncoupled from the adding device 20. In the case of mechanical coupling, the adding device 20 is advantageously used as a cover or leak protection for the liquid tank 18. In the case of decoupling, a liquid line, i.e. a capillary connection, is in particular provided between the liquid tank 18 and the adding device 20. If the liquid tank 18 is designed such that it can be separated from the adding device 20, it must be possible to do so without leakage, i.e. the liquid tank 18 comprises a sealing mechanism which, as a result of the liquid tank 18 being separated from the adding device 20, automatically seals, in a liquid-tight manner, a discharge opening of the liquid tank 18, for example by means of a spring-loaded ball, a check valve or the like.

Figure 12:
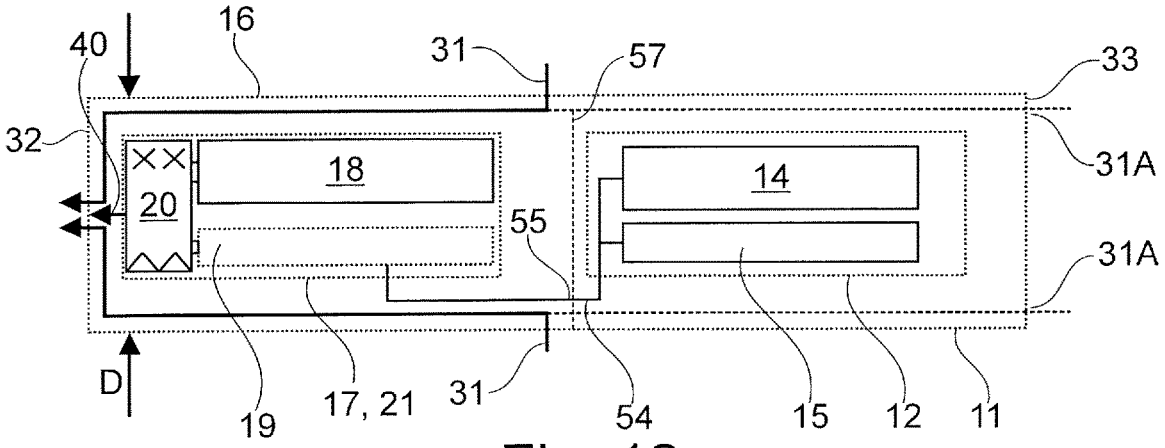

The ratio of the greatest extension of the microsystem unit 45 (see FIG. 3) to the average diameter D of the substantially rod-shaped housing 11 in the region of the adding device 20 (see FIG. 12) is advantageously less than 0.5.

Figure 3:
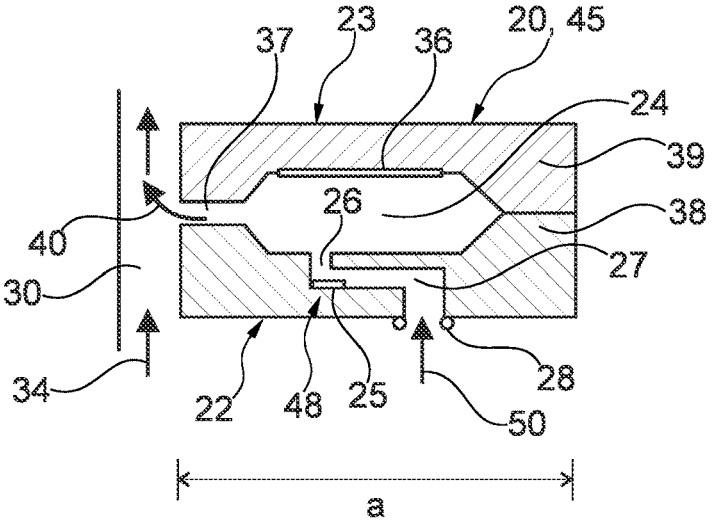
FIG. 3-9 are cross-sectional views of at least partially microsystem-based adding devices for an electronic cigarette product in different embodiments.

An advantageous embodiment of an adding device 20 according to the invention is shown in FIG. 3. The adding device 20 comprises an atomiser component 22 having an atomiser 48 and an evaporator component 23 having an evaporator 49, which are arranged inside the adding device 20 relative to a chamber 24. The atomiser 48 can be a dosing means, such as an open-jet dosing means (e.g.,. an open-jet atomizer).

The atomiser 48 is preferably an open-jet atomiser according to the inkjet or bubblejet principle, comprising an actuator 25 arranged in a liquid channel 27 and a nozzle 26 which is arranged downstream thereof and opens into the chamber 24. The actuator 25, which is electrically actuated at a suitable actuating frequency typically in the kHz range, may be a piezoelectric element or a heating element. If an air flow 34 through the air channel 30 caused by the user drawing is detected, the control assembly 29 actuates the actuator 25, whereupon the liquid in the liquid channel 27 is projected from the nozzle 26 into the chamber 24, in the form of small droplets, by means of sudden heating (in the case of a heating element) or shaking (in the case of a piezo element).

As an alternative to an open-jet atomiser according to the inkjet or bubblejet principle, other types of atomiser may be used, for example driven by a pressure difference, either from the air flow 30 itself or by means of admission pressure on or in the liquid tank 18 or ultrasound atomiser.

In the embodiment, the atomiser 48 is used as an open-jet atomiser according to the inkjet or bubblejet principle at the same time as the liquid 50 is conveyed out of the liquid tank 18 through the liquid channel 27 and as the liquid is dosed into the chamber 24. The atomiser 48 can therefore also be referred to as an open-jet dosing means. Additionally and/or alternatively, micropumps and microvalves, conveyance having integrated liquid temperature control (in advance), which is illustrated further below, and/or pressure difference-driven, either out of the air flow 30 itself or on or in the liquid tank 18 by means of admission pressure, in order to convey and/or dose the liquid.

The atomiser 48 is adjusted such that an advantageous amount of liquid in the region between 1 μl and 10 μl typically 4 μl, is added per drag of the user. Preferably, the atomiser 48 is designed such that a (dosing) reserve is available. Preferably, the atomiser 48 can be adjusted with regard to the amount of liquid per drag.

In addition or as an alternative to the atomiser 48, other means may be used to supply the liquid 50 from the liquid tank 18 to the atomiser 48, for example in the form of at least one pump, for example a membrane pump, a peristaltic pump, a displacement pump, for example comprising a spindle drive, or a gear pump. Alternatively, the vacuum in the air flow 30 produced by the user could be used to convey the liquid 50, for example via a connecting pipe.

The control assembly 29 may advantageously be designed for setting different user profiles. In particular, the rate at which vapour is dosed may advantageously be adjustable for the user in specific regions. For example, three vapour output levels having a high amount of vapour, a moderate amount of vapour, and a low amount of vapour, corresponding to 400, 500 and 600 drags per 2 ml cartridge 21, for example, could be selected. This can be implemented by the frequency of actuating the atomiser 48, for example. In embodiments of this kind, the dimensioning of a heating element 36 is designed for the highest vapour output that can be selected.

As an alternative to a separate liquid tank 18, a single storage/atomiser unit in the form of a liquid-on-chip system may be used. This is a plurality of individual liquid reservoirs that are integrated on a printed circuit board and can be individually electrically actuated or "shot" in order to release the liquid stored therein. Typical blister sizes are in the range between 150 μl and 5 ml. A liquid-on-chip system may also be provided for adding an active ingredient in parallel with a liquid tank for adding a base liquid.

Preferably, an electric DC voltage may be applied to metal parts of the atomiser 22, for example the heating element 36 and/or the nozzle 26, in contact with the liquid, in order to ionise the atomised liquid. This can advantageously achieve finer droplets, better spatial distribution of the atomised liquid and/or a force of attraction of the droplets towards the heating element 36 of the evaporator 23 (see below). This may be particularly advantageous for pharmaceutical applications.

The evaporator 49 comprises a heating element 36 that is actuated by the control assembly 29 when an air flow 34 through the air channel 30 due to the user drawing is detected, in order to be heated by electricity from the energy source and to evaporate the droplets leaving the nozzle 26, i.e. to transfer said droplets into the gaseous or vapour state. In order to achieve optimal evaporation, the heating element 36 is preferably arranged opposite the nozzle 26. The heating element 36, which can be electric, may be designed in particular as a heating plate having a planar or structured surface. The size and surface finish or structure of the heating element 36 is preferably adapted to the viscosity and surface tension or wettability of the liquid. A polar coating is also possible.

The heating element 36 is actuated by the control assembly 29, in particular by the electrical/electronic unit 19, such that said element has a substantially constant evaporating temperature preferably in the range between 100° C. and 400° C. This may occur advantageously by regulating the heat output. Preferably, a power reserve is provided for the heating element 36. The evaporative capacity is preferably in the range between 1 W to 20 W, more preferably in the range between 2 W and 10 W.

In the case of a plurality of evaporator heating elements 36, 36A (see FIG. 7 to FIG. 9) for evaporating a plurality of liquids 50, 50A, the heating elements 36, 36A are preferably regulated separately in order to be able to ensure an optimal evaporating temperature for each component. Staggered evaporation of different liquids 50, 50A is also conceivable, the droplets being shot out of the different nozzles alternately in a clocked manner onto the heating elements 36, 36A. This can lead to more uniform evaporation. Furthermore, in an embodiment of this kind, it is possible to achieve an adapted evaporation temperature even with only one heating element.

The atomiser/evaporator combination may be advantageously adjusted such that predominantly liquid particles in the range between 0.25 μm and 10 μm are produced, for which an optimal absorption of the active ingredient or respirability is given.

As the chamber 24 is used in particular for evaporating the droplets leaving the nozzle 26, the chamber 24 can also be referred to as an evaporator chamber. The chamber 24 is preferably elongate in cross section, as shown in FIG. 3 for example, the nozzle 26 and the heating element 36 preferably being arranged on opposite long sides. An outlet hole 37 is provided preferably perpendicularly or laterally to the direction in which the liquid stream leaves the nozzle 26, through which hole the vapour produced by the evaporator 49 exits the chamber 24, where said vapour is carried and absorbed by the air flow 34 extending preferably perpendicularly to the outlet hole 37.

In advantageous embodiments, the heating element 36 may be equipped with a piezo element. The heating element 36 vibrating due to piezo excitation can lead to more effective evaporation and/or achieve self-cleaning effects, i.e. preventing scorching or adhesions.

Optionally, the vapour may be temperature-controlled or preheated to a desired temperature, for example body temperature (37° C.). This can take place advantageously by means of a corresponding heating element or a heat exchanger. The vapour may also optionally be swirled, for example in a mixing chamber with ambient air, or by suitable design of a mouthpiece of the cigarette product 10, for example by means of holes at 45°, helix structures, a de Laval nozzle and the like.

As the actuator 25 of the atomiser 22 and the heating element 36 of the evaporator 23 are separately electrically connected to the control assembly 29 and are actuated separately from one another, there is an advantageous functional separation of conveying/dosing/atomising on one hand and evaporating on the other.

The liquid channel 27 is preferably sealed by means of a seal 28 that is arranged between the adding device 20 and the liquid tank 18 and surrounds the opening of the liquid channel 27 on the outside.

Different sensor systems in the cigarette product 10 for sensory monitoring and/or regulation are described in the following.

Preferably, a sensor system is provided for measuring and/or regulating the temperature of the heating element 36. This can take place, for example, by means of a temperature sensor, a resistance-variable conducting coating of the heating element 36, or by measuring the energy loss after the heating plate 36 has been cooled by impinging liquid. Furthermore, a sensor system is preferably provided for measuring and/or regulating the temperature of the ingoing air, i.e. of the air flow 34 before the liquid is added by the adding device 20. Equally advantageously, the temperature of the vapour or aerosol 40 is measured and/or regulated, in particular in the chamber 24 and/or in the air flow 34 after the liquid is added by the adding device 20. It is also conceivable to use a potential of hydrogen (pH) sensor.

The air aspirated through the air inlet opening 31 is conducted to the adding device 20 in the air channel 30, optionally via the interface or separating surface 57. A filter, in particular a fine filter for filtering dust particles out of the aspirated air, may be arranged in the air channel 30. Furthermore, a pressure or flow switch 44 for activating the atomiser 48 and the evaporator 49 due to an air flow 34 being produced by the user is arranged in the air channel 30 such that the air flow 34 flows past said switch. In the throughflow variant, the flow switch 44 may be arranged in the chamber 24; see e.g. FIG. 5 and FIG. 6. Alternatively, the flow switch 44 may be arranged at a suitable location in the air channel 30 outside the chamber 24. The flow switch 44 may advantageously be integrated in the electrical/electronic unit 19; in this case, the air channel 30 is advantageously arranged such that the air flow 34 flows past the electrical/electronic unit 19. The flow switch 44 may be a vacuum switch, for example according to the principle of the capacitor microphone. In addition or as an alternative to the flow switch 44, it may be possible to switch the cigarette product on and off by means of a mechanical switch, a capacitive switch, which is sensitive to the user touching the housing 11 or the mouth end 32, or a touchscreen.

The vapour or aerosol 40 is supplied to the air flow 34 by said flow flowing past the outlet opening 42 of the chamber 24 (see FIG. 1, FIG. 3, FIG. 4, FIG. 7, FIG. 8, FIG. 9, FIG. 11 and FIG. 12). In alternative embodiments, the air flow 34 flows through the adding device 20 and, in the chamber 24, the vapour or aerosol 40 is carried and absorbed by the air flow 30 (see FIG. 5, FIG. 6 and FIG. 10). In the embodiment according to FIG. 1, the vapour or aerosol 40 is added perpendicularly to the air flow 34 that flows eccentrically and in the axial direction of the cigarette product 10. In the embodiment according to FIG. 10, the air flow 34 flows through the adding device 20 perpendicularly to the axial direction of the cigarette product 10. In the embodiment according to FIG. 11, the vapour or aerosol 40 is added axially centrally in the opposite direction to the axial direction of the main flow of the air flow 34 flowing through the cigarette product 10. In the embodiment according to FIG. 12, the vapour or aerosol 40 is added axially centrally in the axial direction of the main flow of the air flow 34 flowing through the cigarette device 10.

Figure 10:
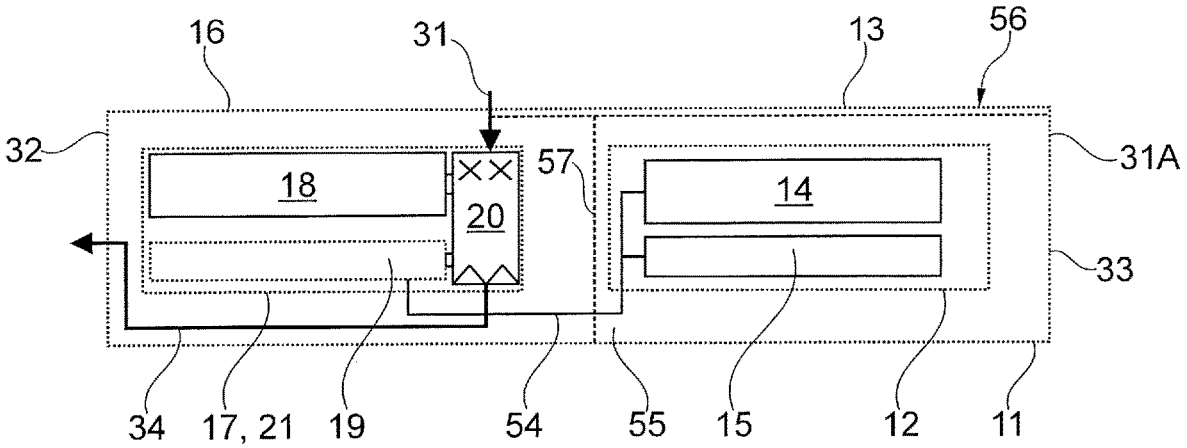
FIG. 10-12 are cross-sectional views of an electronic cigarette product in further embodiments of the invention.
Figure 11:
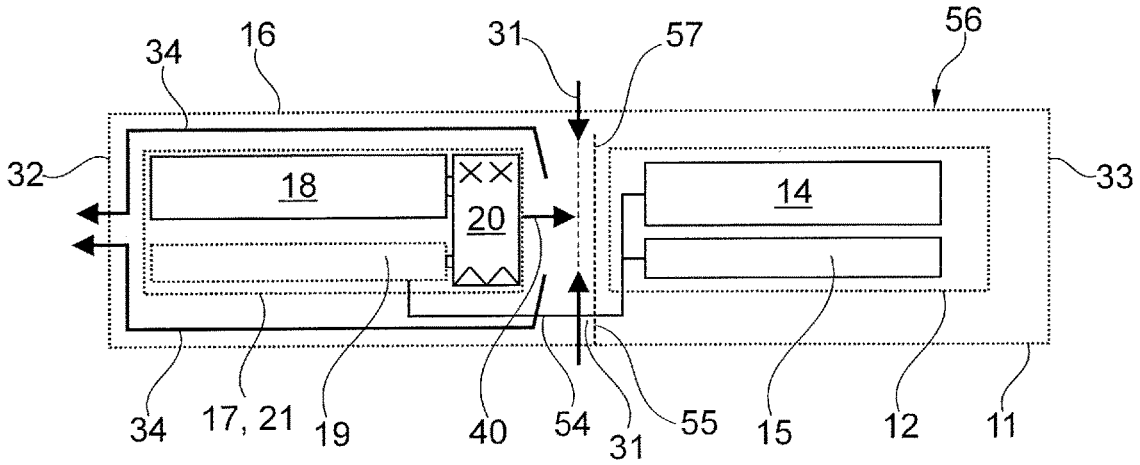

The adding device 20 may be arranged remotely from the mouth end 32 of the cigarette device 10, in particular in the region of the interface 57 between the cartridge 21 and the main part 56, as in the embodiments according to FIG. 1, FIG. 10 and FIG. 11. The adding device 20 may alternatively be arranged near the mouth end 32 of the cigarette device 10, as in the embodiment according to FIG. 12. It is also possible to arrange said device at the side of the liquid tank 18, in particular in the region of the electrical/electronic unit 19.

Preferably, a sensor system is provided for measuring and/or regulating the liquid volume flow rate or various liquids or fluid components (see below). This may take place, for example, by counting the number of droplets and/or evaluating the actuation frequency of the actuator 25, or by evaluating the heat output or change in temperature of the heating element 36.

Equally advantageously, a sensor system may be provided for measuring the volume flow rate of the air flow 34 either before or after the liquid is added by the adding device 20. This can take place by evaluating the activation time of a pressure switch by taking into consideration the flow geometry, for example.

Preferably, the cigarette product 10 contains one or more pressure sensors for measuring and/or monitoring the pressure or vapour pressure in the chamber 24 and/or the pressure in the air channel 30, for example for activating or switching the adding device 20, and/or for testing for leaks between the adding device 20 and the liquid tank 18.

In the embodiment according to FIG. 3, both the atomiser component 22 and the evaporator component 23 are implemented, using microsystem technology, on a substrate, for example made of a polymer, glass, ceramic, metal, metalloid, e.g. silicon, silicon compounds or metal oxide compounds. Microsystem units comprise electrical and/or mechanical structures having dimensions in the micrometre or sub-millimetre range, which structures are incorporated into a substrate in a single processing operation. In the case of an atomiser component 22, in particular the liquid channel 27, the electrical actuator 25 and optionally a sensor system provided in the atomiser component 22 are incorporated into the substrate 38 in a single processing operation of microsystem technology. In the case of an evaporator component 23, in particular the heating element 36 and optionally a piezo element for vibrating the heating element 36 and a sensor system arranged in the evaporator component 23 are incorporated into the substrate 38 in a single processing operation of microsystem technology. In the embodiment according to FIG. 3, the entire adding device 20 is therefore designed as a single microsystem unit 45.

In the embodiment according to FIG. 3, the heating element 36 is planar and parallel to the surface of the substrate 39, i.e. virtually "horizontal".

Figure 4:
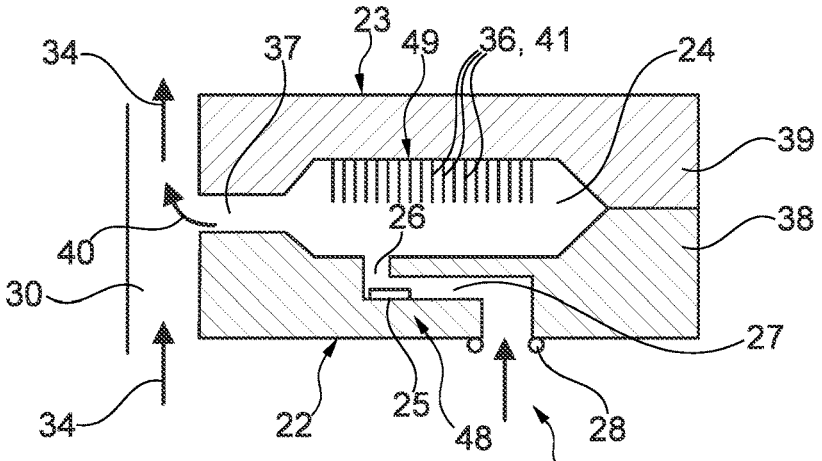

The embodiment according to FIG. 4 differs from the embodiment according to FIG. 3 in that here the heating element 36 consists of a plurality of heating rods 41 that protrude perpendicularly from the corresponding surface of the substrate 39, i.e. of a virtually "vertical" three-dimensional heating element structure.

Figure 5:
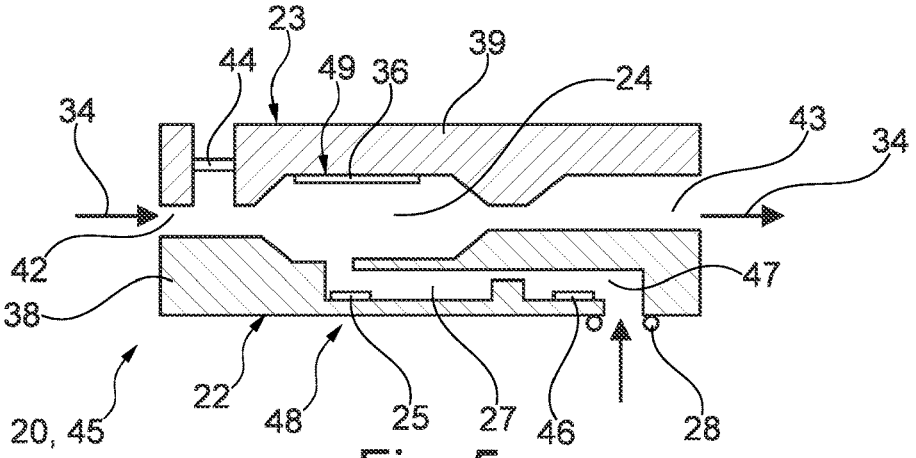
Figure 6:
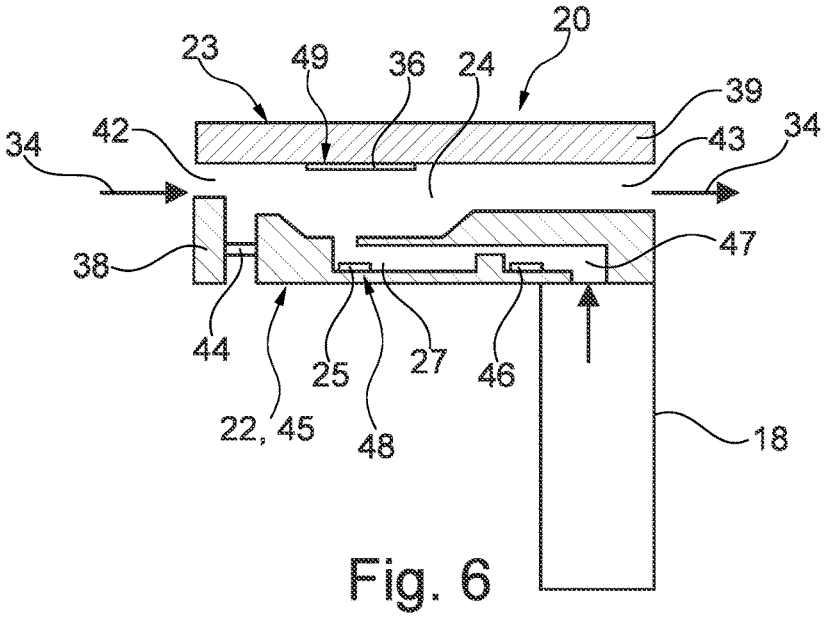

In the embodiments according to FIG. 5 and FIG. 6, the air flow 34 produced by the user flows through the adding device 20 and the adding device thereby carries the vapour or aerosol produced in the chamber 24. For this purpose, an air inlet opening 42 and an air outlet opening 43 are provided in the adding device 20. The pressure switch 44, for example a capacitor switch, for activating the atomiser 48 and the evaporator 49 due to the user producing an air flow 34 is advantageously integrated in the microsystem unit 45, for example into the evaporator component 23 (see FIG. 5), alternatively in the atomiser component 22 (see FIG. 6).

Advantageously, a preheating means comprising a preheating element 46 and a preheating chamber 47 may be arranged in the liquid channel 27, as shown in the embodiments according to FIG. 5 and FIG. 6, for example.

In the embodiment according to FIG. 6, only the atomiser component 22 is designed as a microsystem unit 45, whereas the substrate 39 of the evaporator component 23 is produced from a non-conductive material, in particular glass, ceramic or a plastics material. This design may be more cost-effective and therefore advantageous. The evaporator component 23 is advantageously connected or bonded to the atomiser component 22. The liquid tank 18 preferably consisting of a plastics material, for example PDMS (polydimethylsiloxane), is advantageously also connected or bonded to the atomiser component 22 or the microsystem unit 45 rigidly and in a liquid-tight manner, for example glued or welded thereto.

Figure 7:
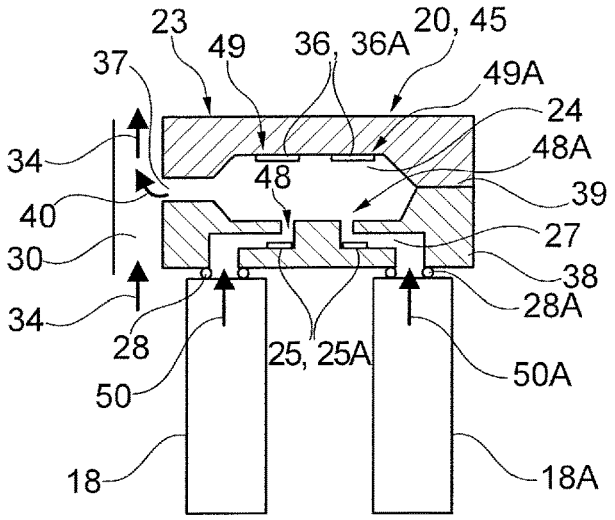
Figure 8:
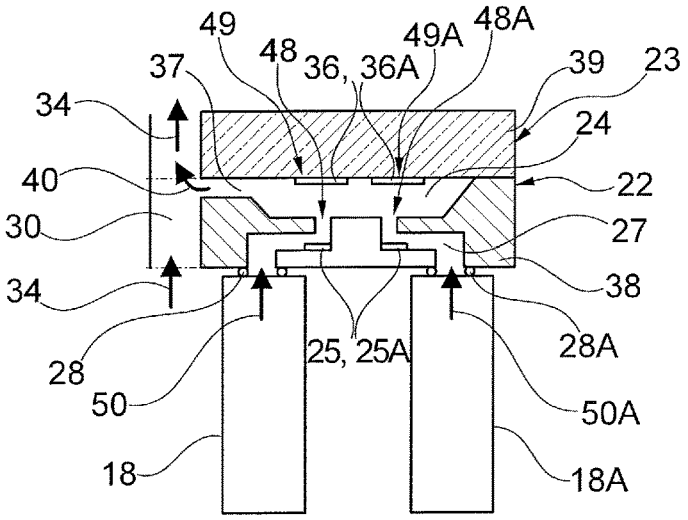

The embodiments according to FIGS. 7 and 8 relate to an advantageous variant of the invention, in which different liquids 50, 50A, for example the liquid 50 and a separate fluid active ingredient 50A, from a plurality of liquid tanks 18, 18A are atomised by a plurality of atomisers 48, 48A, in this case open-jet atomisers according to the inkjet or bubblejet principle having actuators 25, 25A, and are evaporated by a plurality of corresponding evaporators 49, 49A or heating elements 36, 36A. The atomiser component 22 and the evaporator component 23 are designed as a single microsystem unit or assembly 45 in the case of FIG. 7. In the case of FIG. 8, the design is comparable with the design from FIG. 6, i.e. only the atomiser component 22 is designed as a microsystem unit, whereas the substrate 39 is produced from a non-conductive material, in particular glass, ceramic or a plastics material.

An alternative variant for supplying the active ingredient consists in mixing said active ingredient into the liquid 50 as a homogeneous mixture.

Figure 9:
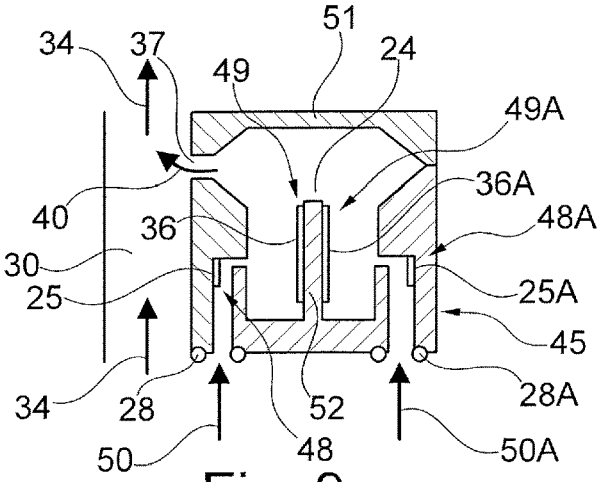

The embodiment according to FIG. 9 can be used to supply the same liquid 50 or different liquids 50, 50A. In this case, the atomisers 48, 48A and the evaporators 49, 49A are arranged on the same microsystem unit 45 and the chamber 24 is sealed, with respect to the microsystem unit 45, by a cover 51 made of a suitable material. In this case, the heating elements 36, 36A are arranged on opposite sides of a partition 52 that projects perpendicularly into the chamber 24, and thereby form a "vertical" heating element structure.

All the embodiments shown in the drawings comprise one or more evaporators 49. However, embodiments without evaporators are conceivable, for example for medicinal applications. In this case, it may be sufficient to produce an aerosol and supply said aerosol to the air flow 30 by means of atomisers 48. If an open-jet atomiser according to the inkjet or bubblejet principle is used, droplets having an average size in the range between 10 μm and 50 μm, preferably between 20 μm and 40 μm, typically approximately 30 μm, can be produced, for example. The dosing frequency is typically in the kHz range.

In practical embodiments, a plurality of atomisers 48, for example in the form of a matrix, may advantageously be arranged in the adding device 20. A corresponding plurality of evaporators 49 may be assigned to the plurality of atomisers 48, for example likewise in the form of a matrix. The adding device 20 can therefore also be referred to as an array, in microsystem design as an MST array. There are preferably between two and twenty, more preferably between three and ten, atomisers 48.

In order to produce larger amounts of vapour, a plurality of adding devices 20 or microsystem units 45 may be arranged in the cigarette product.

The consumption unit 17 or the cartridge 21 advantageously comprises a non-volatile information store 53 (see FIG. 1) for storing information or parameters relating to the consumption unit 17 or the cartridge 21, for example implemented as EEPROM, RFID or in another suitable form. The information store 53 may be part of the electrical/electronic unit 19 or formed separately therefrom. The following information is advantageously stored in the information store 53: information regarding the ingredients, i.e. the composition of the liquid stored in the liquid tank 18; information regarding the process profile, in particular power/temperature control; data regarding state monitoring or system checking, for example leak testing; data relating to copy protection and forgery protection, in particular comprising an ID for unique information regarding the consumption unit 17 or cartridge 21; serial number, date of manufacture and/or expiry date; and/or drag number (number of inhalation drags by the user) or usage time.

There is advantageously an electrical connection 54 between the consumption unit 17 or the cartridge 21 and the energy supply unit 12 via a corresponding electrical interface 55, which interface makes it possible to replace the cartridge 21. The electrical connection 54 is used to exchange data between the consumption unit 17 or the cartridge 21 and the energy supply unit 12 and to supply electricity to the consumption unit 17 or the cartridge 21 by means of the electrical energy store 14. The data exchange may take place via direct electrical coupling, for example by means of spring contact elements, a radio connection or an optical connection.

All the electrical contacts of the cartridge 21 for supplying energy, optionally also for transmitting data, are advantageously guided outwards in the form of a single electrical interface 55, for example in the form of a contact array, a secure electrical connection to the main part 56 being produced, advantageously by means of spring contact elements. Electricity could alternatively be supplied to a direct electrical coupling, for example, by means of spring contact elements, for example inductively. The mechanical connection between the cartridge 21 and the main part 56 may be suitably formed, for example by means of a screw thread, a plug-in connection, a bayonet mount, magnetically or in another way. In the way described, a standard cartridge 21 can be flexibly connected to an individually designed main part 56.

The energy supply unit 12 or the main part 56 advantageously comprises a communication interface 59 (see FIG. 1) for external communication with an external communication device, for example a mobile telephone. The communication interface 59 preferably comprises a radio module, for example designed for near field communication (NFC), Bluetooth, Wi-Fi or ANT+. Additionally or alternatively, an external plug-in connection, for example a USB socket for a USB connection, is possible. The communication interface 59 may be part of the electrical/electronic unit 15 or formed separately therefrom.

The energy supply unit 12 or the main part 56 may advantageously comprise a charging interface 60 for charging the energy store 14. The charging interface 60 may permit charging by induction, for example. Alternatively, it may be a plug-in connection or another direct electrical connection, for example a USB connection. Instead of a charging interface, the energy store may also be designed as an exchangeable accumulator or exchangeable battery, it being possible for a user to remove a discharged energy store 14 from the cigarette product 10 and for a charged energy store 14 to be reinserted. Other embodiments comprising a disposable energy store 14, in particular a battery, without a loading interface 60 are also conceivable, the main part being disposed of after the energy store 14 has been discharged.

The electrical/electronic unit 15 of the main part 56 is preferably designed to carry out diagnosis functions, in particular via software, for example to detect malfunctions, for example to check the nozzles 26, 37 and/or to check the evaporator 49, including the plausibility of the evaporator capacity; and/or to check the charging state of the energy store 14. The electrical/electronic unit 15 may further comprise a safety device, for example a safety fuse for short-circuit protection, and/or a device for protecting against misuse, for example a fingerprint sensor.

The electrical/electronic unit 15 of the main part 56 is advantageously designed to carry out statistical analyses, in particular via software. Said analyses could, for example, relate to the behaviour of the user, for example the drag number over time, the consumption of liquid in general and/or per cartridge, the nicotine or ingredient intake, the liquid composition and the like. Further aspects of a statistical analysis may relate to market developments and trends. An API may also be provided for application programming, which API makes it possible, for example, to display all the sensor information in any desired combination.

The electrical/electronic unit 15 of the main part 56 is advantageously designed to visualise data or information on a display device, in particular via software. This may be an internal display device, in particular a monitor, screen, touchscreen or LED display in the housing 11 of the main part 56. Additionally or alternatively, the data or information may be visualised on an external display device, for example a mobile telephone. The visualised information may include an image of the statistical analysis, a trend over time and/or information regarding a current user profile, relating, for example, to the system state (charging state of the energy store 14), volume of vapour, cartridge contents etc.

Figure 13:
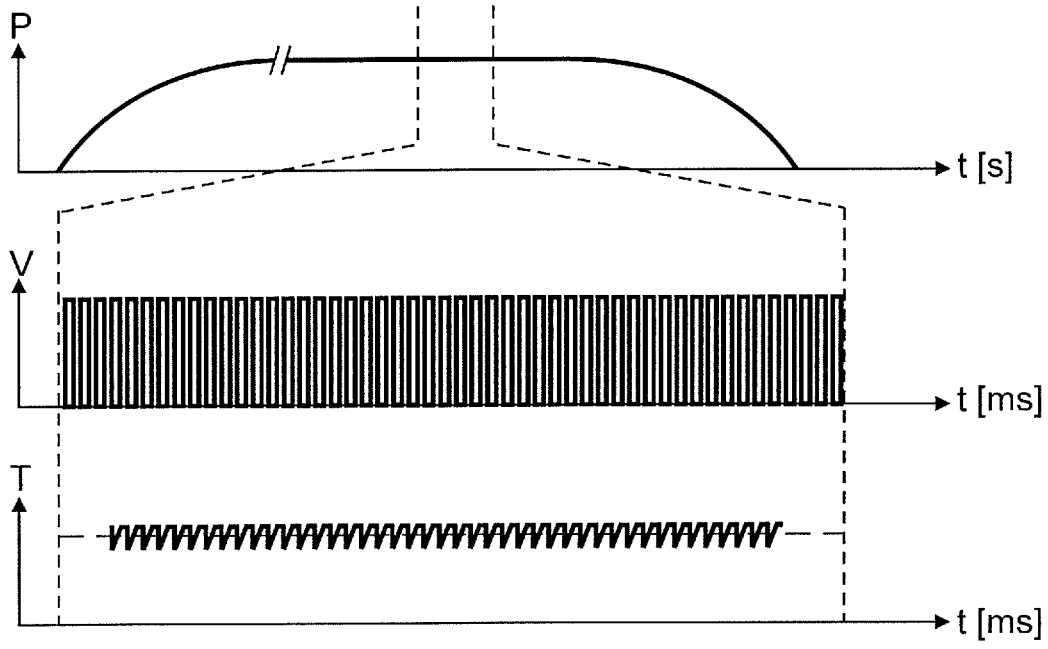
FIG. 13 shows time diagrams to explain regulating the evaporator temperature in an advantageously pulsed manner.

Diagrams explaining possible temperature and heat output control or regulation are shown in FIG. 13. The drag resistance of the air flow 34 is plotted at the top, the volume flow rate of the liquid 50 is plotted in the centre, and the temperature of the heating element 36 is plotted at the bottom, in each case over time. In this case, the temperature is detected for example by the change in resistance due to cooling when wetted with liquid and the output is readjusted accordingly. In this case, a pulsed supply of heat energy with "droplet by droplet" voltage pulses may be advantageous in particular in the sub-ms range.

Figure 14:
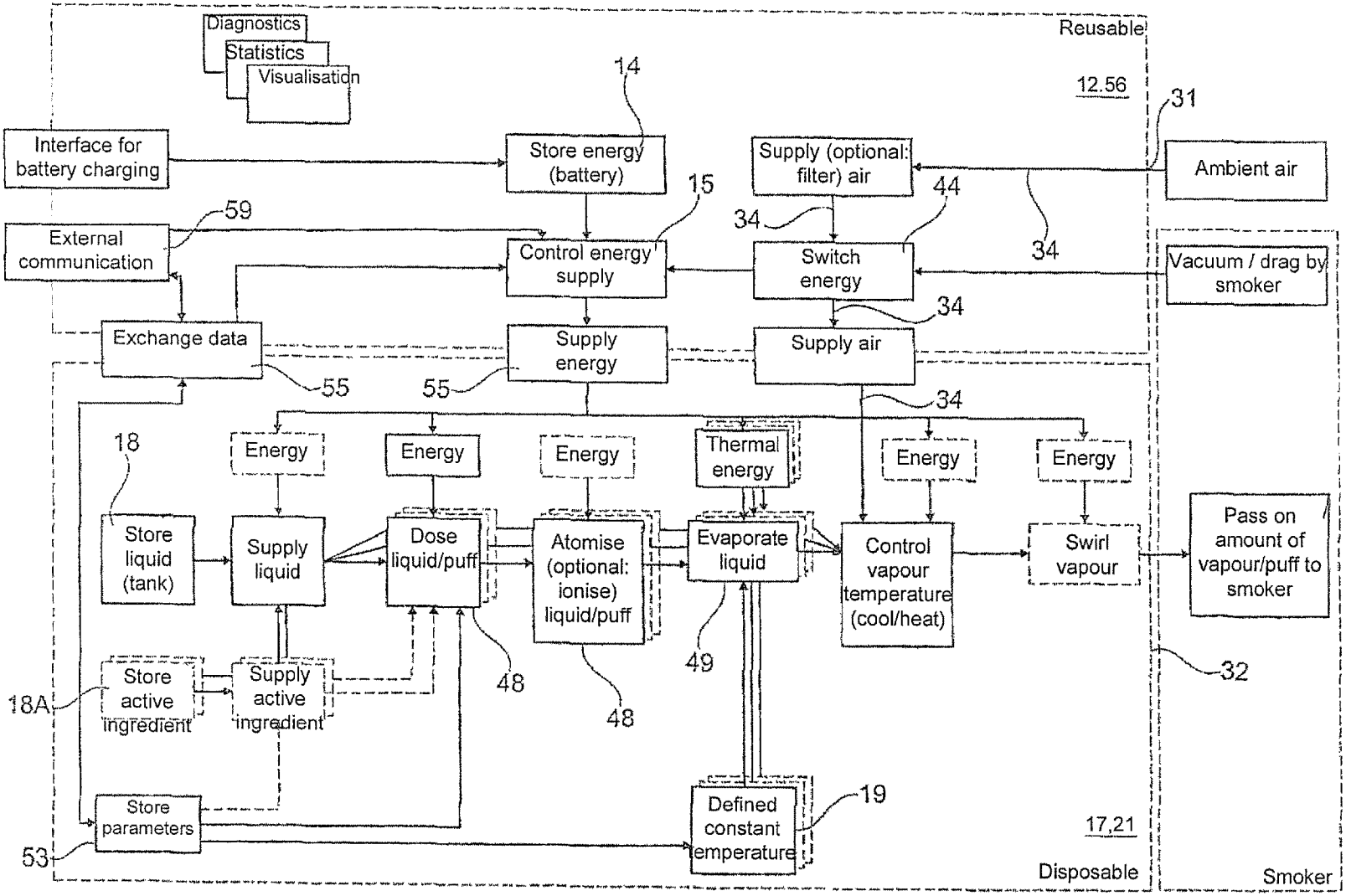
FIG. 14 is a functional diagram of a cigarette product according to the invention.

FIG. 14 shows a functional circuit diagram of the cigarette product 10 according to the invention, which diagram is substantially self-explanatory on the basis of the above-described with the aid of the inserted reference signs.

In all the embodiments shown in the drawings, the consumption unit 17 or the cartridge 21 comprises an electrical control unit 19 and additional electrical components, in particular actuators 25 and heating elements 36. However, other embodiments are possible in which the electrical control unit 19 and/or the additional electrical components are arranged entirely in the reusable main part 56, so that the number of electrical components in the consumption unit 17 or cartridge 21 is reduced, or the consumption unit 17 or cartridge 21 comprise passive electrical components (passive data store 53 such as RFID, transponders or the like) at most, or is free of electrical components. These embodiments have the advantage that, advantageously, no electrical contacting of the cartridge 21 via the electrical interface 55 is required.

EMBODIMENTS

Embodiment 1. Electronic cigarette product (10), comprising a housing (11) having a mouth end (32), at least one air inlet opening (31) and an air channel (30) that extends in the housing between the at least one air inlet opening (31) and the mouth end (32), a liquid tank (18), an electrical energy store (14) and an adding device (20), connected to the liquid tank (18), for producing vapour and/or aerosol from liquid (50) taken from the liquid tank (18) and for adding the vapour and/or aerosol (40) to an air flow (34) flowing in the air channel (30), characterised in that the adding device (20) consists of a microsystem unit at least in part.

Embodiment 2. Electronic cigarette product according to Embodiment 1, characterised in that the liquid tank (18) and the adding device (20) are connected in a replaceable unit (21).

Embodiment 3. Electronic cigarette product according to Embodiment 2, characterised in that the cartridge (21) comprises an electrical unit (19).

Embodiment 4. Electronic cigarette product according to either Embodiment 2 or Embodiment 3, characterised in that the cartridge (21) comprises an information store (53) for storing information and/or parameters relating to the cartridge (21).

Embodiment 5. Electronic cigarette product according to any of the preceding Embodiments, characterised in that the ratio of the greatest extension of the microsystem unit (45) to the average diameter of the substantially rod-shaped housing (11) in the region of the adding device (20) is less than 0.5.

Embodiment 6. Electronic cigarette product according to any of the preceding Embodiments, characterised in that the adding device (20) comprises an atomiser (48) for atomising the liquid (50) into droplets.

Embodiment 7. Electronic cigarette product according to Embodiment 6, characterised in that the atomiser (48) is foinied as a microsystem unit.

Embodiment 8. Electronic cigarette product according to either Embodiment 6 or Embodiment 7, characterised in that the atomiser (48) is an open-jet atomiser comprising a thennoactuator or piezo actuator (25) and a nozzle (26) arranged downstream thereof.

Embodiment 9. Electronic cigarette product according to any of Embodiments 6 to 8, characterised in that the atomiser (22) comprises an electric preheating element (46) and a preheating chamber (47) for preheating the liquid entering the adding device (20) from the liquid tank (18).

Embodiment 10. Electronic cigarette product according to any of Embodiments 6 to 9, characterised in that an electric DC voltage is applied to a metal part of the atomiser (48) in contact with the liquid, in order to ionise the atomised liquid.

Embodiment 11. Electronic cigarette product according to any of the preceding Embodiments, characterised in that the adding device (20) comprises an evaporator (49) having an electric heating element (36).

Embodiment 12. Electronic cigarette product according to Embodiment 11, characterised in that the evaporator (49) is designed as a microsystem unit.

Embodiment 13. Electronic cigarette product according to either Embodiment 11 or Embodiment 12, characterised in that the heat output of the heating element (36) can be controlled and/or regulated to a defined desired temperature.

Embodiment 14. Electronic cigarette product according to any of Embodiments 11 to 13, characterised in that the evaporator (23) comprises a piezo element that is coupled to the electric heating element (36).

Embodiment 15. Electronic cigarette product according to Embodiments 6 and 11, characterised in that the atomiser (48) and the evaporator (49) can be electrically actuated mutually independently.

Embodiment 16. Electronic cigarette product according to any of the preceding Embodiments, characterised in that different liquids (50, 50A) from a plurality of liquid tanks (18, 18A) are atomised by means of a plurality of atomisers (48, 48A).

Embodiment 17. Electronic cigarette product according to Embodiment 16, characterised in that a corresponding plurality of evaporators (49, 49A) having heating elements (36, 36A) are assigned to the atomisers (48, 48A).

Embodiment 18. Electronic cigarette product according to Embodiment 17, characterised in that the heat output of the heating elements (36, 36A) can be individually controlled and/or regulated to defined desired temperatures.

Embodiment 19. Electronic cigarette product according to any of the preceding Embodiments, characterised in that the liquid tank (18) contains at least one flexible pouch.

Embodiment 20. Electronic cigarette product according to any of the preceding Embodiments, characterised in that a liquid store or atomiser unit is provided in the form of a liquid-on-chip device.

Embodiment 21. Electronic cigarette product according to any of the preceding Embodiments, characterised in that a plurality of atomisers (48) are arranged in parallel in the adding device (20) in particular in the form of a matrix or an array.

Embodiment 22. Electronic cigarette product according to any of the preceding Embodiments, characterised in that a plurality of adding devices (20) are arranged in parallel in the cigarette product (10).

Embodiment 23. Electronic cigarette product according to any of the preceding Embodiments, characterised in that the cigarette product (10) comprises a communication interface (59) for external communication.

Embodiment 24. Cartridge (21) for an electronic cigarette product, comprising a liquid tank (18) and an adding device (20), connected to the liquid tank (18), for producing vapour and/or aerosol from liquid (50) taken from the liquid tank (18) and for adding the vapour and/or aerosol to an air flow (34), characterised in that the adding device (20) comprises a microsystem unit (45) at least in part.

The invention claimed is:

1. An electronic cigarette product comprising:
a housing,
wherein the housing comprises:
a mouth end; and
at least one air inlet opening;
an air channel that extends in the housing between the at least one air inlet opening and the mouth end;
a liquid tank;
an adding device; and
an electrical energy store electrically connected to the adding device and configured to provide energy thereto,
wherein the adding device is connected to the liquid tank,
wherein the adding device takes liquid from the liquid tank and produces vapor and/or aerosol from the liquid,
wherein the adding device adds the vapor and/or aerosol to an air flow flowing in the air channel,
wherein the adding device comprises a microsystem unit,
wherein the adding device comprises an atomizer,
wherein the atomizer atomizes the liquid into droplets,
wherein the microsystem unit comprises the atomizer, and
wherein the atomizer is an open-jet atomizer comprising a thermoactuator or piezo actuator and a nozzle arranged downstream of the thermoactuator or piezo actuator.

2. The electronic cigarette product according to claim 1, further comprising:
a replaceable unit,
wherein the liquid tank and the adding device are connected in the replaceable unit.

3. The electronic cigarette product according to claim 2,
wherein the replaceable unit is configured as a cartridge, and
wherein the cartridge comprises an electrical control unit electrically connected to the adding, device and configured to control the adding device.

4. The electronic cigarette product according to claim 2,
wherein the cartridge comprises an information store for storing information and/or parameters relating to the cartridge.

5. The electronic cigarette product according to claim 1,
wherein the housing is substantially rod-shaped, and
wherein a ratio, of a greatest length of the microsystem unit in a length dimension of the housing to an average diameter of the housing in a region of the adding device, is less than 0.5.

6. The electronic cigarette product according to claim 1,
wherein the atomizer comprises an electric preheating element and a preheating chamber, and
wherein the liquid enters the adding device and is preheated in the preheating chamber via the preheating element.

7. The electronic cigarette product according to claim 1,
wherein the atomizer comprises a metal part in contact with the liquid, and
wherein an electric DC voltage is applied to the metal part in order to ionize the droplets.

8. The electronic cigarette product according to claim 1,
wherein the adding device comprises an evaporator having an electric heating element, and
wherein the evaporator evaporates the droplets.

9. The electronic cigarette product according to claim 8, further comprising an electrical control unit electrically connected to the electric heating element and configured to control the electric heating element,
wherein the electric heating element is configured such that a heat output thereof is controllable by the electrical control unit in order to achieve a desired temperature.

10. The electronic cigarette product according to claim 8,
wherein the evaporator comprises a piezo element that is coupled to the electric heating element.

11. The electronic cigarette product according to claim 8,
wherein the atomizer and the evaporator are electrically actuated independently.

12. The electronic cigarette product according to claim 1,
wherein the adding device comprises an evaporator having an electric heating element, and
wherein the evaporator evaporates the droplets, and
wherein the microsystem unit comprises the evaporator.

13. The electronic cigarette product according to claim 1, further comprising:
a plurality of liquid tanks,
wherein the plurality of liquid tanks comprises the liquid tank;
wherein the adding device is connected to the plurality of liquid tanks,
wherein the adding device takes a corresponding plurality of different liquids from the plurality of liquid tanks and produces a corresponding plurality of vapor and/or aerosol from the plurality of different liquids,
wherein the adding device adds the plurality of vapor and/or aerosol to the air flow flowing in the air channel,
wherein the adding device comprises a corresponding plurality of atomizers,
wherein the plurality of atomizers comprises the atomizer,
wherein the plurality of different liquids from the plurality of liquid tanks are atomized via the plurality of atomizers into droplets.

14. The electronic cigarette product according to claim 13,
wherein the adding device comprises a corresponding plurality of evaporators having a corresponding plurality of heating elements, and
wherein the plurality of evaporators evaporate the corresponding droplets.

15. The electronic cigarette product according to claim 14, further comprising an electrical control unit electrically connected to the plurality of heating elements and configured to control plurality of heating elements,
wherein the plurality of heating elements are configured such that respective heat outputs thereof are individually controllable by the electrical control unit in order to achieve a corresponding plurality of respective desired temperatures.

16. The electronic cigarette product according to claim 13,
wherein the plurality of atomizers are arranged in parallel in the adding device.

17. The electronic cigarette product according to claim 1,
wherein the liquid tank comprises at least one flexible pouch.

18. The electronic cigarette product according to claim 1,
wherein the liquid tank is provided in the form of a liquid-on-chip device.

19. The electronic cigarette product according to claim 1, further comprising:
a plurality of adding devices,
wherein the plurality of adding devices comprises the adding device;

wherein the plurality of adding devices are arranged in parallel.

20. The electronic cigarette product according to claim 1, further comprising:

a communication interface for external communication, the communication interface being electrically connected to the electrical energy store.

21. A cartridge for an electronic cigarette product, comprising:

an air channel extending from a first end of the cartridge to a second end o the cartridge;

a liquid tank; and an adding device, wherein the adding device is connected to the liquid tank, wherein the adding device takes liquid from the liquid tank and produces vapor and/or aerosol from the liquid, wherein the adding device adds the vapor and/or aerosol to an air flow in the air channel, and wherein the adding device comprises a microsystem unit, wherein the adding device comprises an atomizer, wherein the atomizer atomizes the liquid into droplets, wherein the microsystem unit comprises the atomizer, and wherein the atomizer is an open-jet atomizer comprising a thermoactuator or piezo actuator and a nozzle arranged downstream of the thermoactuator or piezo actuator.

* * * * *